US009034125B2

(12) United States Patent
Igarashi et al.

(10) Patent No.: US 9,034,125 B2
(45) **Date of Patent: *May 19, 2015**

(54) METHOD FOR MANUFACTURING NI BASE ALLOY PIPE STOCK

(71) Applicant: NIPPON STEEL & SUMITOMO METAL CORPORATION, Tokyo (JP)

(72) Inventors: Masaaki Igarashi, Sanda (JP); Kazuhiro Shimoda, Nishinomiya (JP); Tomio Yamakawa, Kawanishi (JP); Hisashi Amaya Amaya, Kyoto (JP)

(73) Assignee: NIPPON STEEL & SUMITOMO METAL CORPORATION, Tokyo (JP)

( * ) Notice: Subject to any disclaimer, the term of this patent is extended or adjusted under 35 U.S.C. 154(b) by 21 days.

This patent is subject to a terminal disclaimer.

(21) Appl. No.: 13/917,951

(22) Filed: Jun. 14, 2013

(65) Prior Publication Data

US 2013/0283879 A1 Oct. 31, 2013

Related U.S. Application Data

(60) Division of application No. 11/643,824, filed on Dec. 22, 2006, now abandoned, which is a continuation of application No. PCT/JP2005/011993, filed on Jun. 29, 2005.

(30) Foreign Application Priority Data

Jun. 30, 2004 (JP) ..... 2004-194357

(51) Int. Cl.

| | |
|---|---|
| ***B21B 19/04*** | (2006.01) |
| ***C22C 19/05*** | (2006.01) |
| ***C21D 8/10*** | (2006.01) |
| ***C22F 1/10*** | (2006.01) |
| *B21B 23/00* | (2006.01) |

(52) U.S. Cl.

CPC ..... *B21B 19/04* (2013.01); *B21B 23/00* (2013.01); *C22C 19/053* (2013.01); *C22C 19/055* (2013.01); *C22C 19/056* (2013.01); *C22F 1/10* (2013.01)

(58) Field of Classification Search

CPC ..... B21B 23/00; C22C 19/056; C22F 1/10
USPC ..... 148/427, 519; 72/97
See application file for complete search history.

(56) References Cited

U.S. PATENT DOCUMENTS

| | | | | |
|---|---|---|---|---|
| 2,154,037 | A | 4/1939 | Eaton | |
| 4,168,188 | A | 9/1979 | Asphahani | |
| 4,245,698 | A | 1/1981 | Berkowitz et al. | |
| 4,400,209 | A | 8/1983 | Kudo et al. | |
| 4,400,210 | A | 8/1983 | Kudo et al. | |
| 4,400,211 | A | 8/1983 | Kudo et al. | |
| 4,400,349 | A | 8/1983 | Kudo et al. | |
| 4,652,315 | A | 3/1987 | Igarashi et al. | |
| 6,623,869 | B1 | 9/2003 | Nishiyama et al. | |
| 8,784,581 | B2 * | 7/2014 | Igarashi et al. | 148/519 |

FOREIGN PATENT DOCUMENTS

| | | |
|---|---|---|
| JP | 58-011737 | 1/1983 |
| JP | 63-274731 | 11/1988 |
| JP | 08-252692 | 10/1996 |
| JP | 11-302801 | 11/1999 |
| JP | 2000-301212 | 10/2000 |
| WO | WO 03/044239 A1 | 5/2003 |

OTHER PUBLICATIONS

T. Yamakawa et al., "Current Advances in Materials and Processes", Report of the ISIJ Meeting, vol. 6, No. 1, 1993, p. 364.

Kh. I. Cheskis and T.V. Maisuradze. "investigation of . . . Alloy KhN781", in Khimicheskoe I Neftyanoe Mashinostroenie, No. 11, pp. 22-24, 1978.

* cited by examiner

*Primary Examiner* — Jessee Roe
(74) *Attorney, Agent, or Firm* — Clark & Brody

(57) ABSTRACT

A method for manufacturing an Ni base alloy pipe stock comprises piercing and rolling a billet by use of Mannesmann piercing and rolling mill. The pipe stock has controlled amounts of C, Si, Mn, P, S, Cr, Ni, Mo, W, Cu, Al, N, with the balance being Fe. With the method, the following equations are satisfied, wherein values of $T_{GBm}$, $P_{sr}$ and $P_{\sigma}$ represented by the following equations (1) to (3) being not more than 1300, not more than 200 and not less than 0, respectively $$T_{GBm}=1380-5000P-100S-4400C \quad (1),$$

$$P_{sr}=Ni+10(Mo+0.5W)+100N \quad (2),$$

$$P_{\sigma}=(Ni-50)+10(N-0.1)-2(Cr-25)-5(Mo+0.5W-6)+12 \quad (3),$$

wherein each element symbol in the equations represents mass % of the element concerned.

4 Claims, No Drawings

METHOD FOR MANUFACTURING NI BASE ALLOY PIPE STOCK

This application is a Divisional of U.S. Ser. No. 11/643,824, now abandoned, filed on Dec. 22, 2006, which is a Continuation of PCT/JP2005/011993 filed on Jun. 29, 2005, which is published as WO2006/003954 on Jan. 12, 2006.

This application is a continuation of the international application PCT/JP2005/011993 field on Jun. 29, 2005, the entire content of which is herein incorporated by reference.

TECHNICAL FIELD

The present invention relates to Ni base alloy pipe stocks, methods for manufacturing the same, and Ni base alloy seamless pipes which are manufactured using such pipe stocks. More specifically, the present invention relates to Ni base alloy pipe stocks, being obtained by piercing and rolling by use of a Mannesmann piercing and rolling mill (hereinafter referred also to as "piercer"), which are excellent in corrosion resistance in an environment which is rich in corrosive substance such as carbon dioxide, hydrogen sulfide, S (sulfur) and chloride ion (hereinafter referred to as a "sour gas environment") in addition to excellent mechanical properties, such as strength and ductility, and suitable for pipe stocks for oil country tubular goods and line pipes, and further suitable for pipe stocks for various structural members of nuclear power plants and chemical industrial plants, and also to the manufacturing methods thereof, and Ni base alloy seamless pipes which are manufactured using the above-mentioned pipe stocks.

BACKGROUND ART

While development of oil wells and gas wells is expanding on a global scale after the first oil shocks, increased demand for energy in developing countries increasingly forces deepening of oil wells and gas wells and the drilling of wells in a sour gas environment with further severe corrosiveness.

With such increased severity in the oil well and gas well environments, for example, various Ni base alloys, higher in strength than ever before and excellent in corrosion resistance, as shown in the Patent Documents 1 and 2, and further a super austenitic stainless steel as shown in the Patent Document 3, have been developed and practically used.

However, economic globalization, such as corporate marriage or reorganization which has rapidly progressed on a world scale through the termination of the cold war between the East and the West, the integration of the EU, or the like intensifies the price competition among companies. Consequently, in the development of oil wells and gas wells, higher efficiency and lower cost are in demand in addition to ensuring safety.

Increased productivity of oil or gas can be attained by using large diameter pipes. Moreover, the further use of strong material enables reduction in the wall thickness of the pipes, resulting in saving of material cost. Therefore, as a steel stock for pipes used in oil wells and gas wells, a material cost saving and having a higher strength than ever before is requested. The enlargement of the diameter of the pipes is also important.

On the other hand, in the development of oil wells and gas wells, reduced costs can be attained by using inexpensive material which has sufficient strength and corrosion resistance.

The Patent Document 4 thus discloses a "high Cr-high Ni alloy, excellent in stress corrosion cracking resistance", which is enhanced in economical property by reducing the Mo content in alloys which contain, by weight %, 20 to 35% of Cr and 25 to 50% of Ni.

If piercing and rolling by a piercer can be adapted, pipe stocks for large diameter pipes or sufficiently long pipes can be efficiently manufactured at a low cost on an industrial scale.

The Patent Document 5 therefor discloses a "method for piercing a seamless tube of hard-to-work material with piercer", which is intended to provide a manufacturing method of seamless pipes, capable of manufacturing a pipe stock for seamless pipes by a piercer without causing pipe inside surface defects resulting from overheating.

Further, the Non-Patent Document 1 discloses a technique capable of performing rolling, in the piercing and rolling of high Cr-high Ni alloys, without causing inside surface scabs or two-piece cracks by increasing the roll cross angle and the roll feed angle.

Patent Document 1: U.S. Pat. No. 4,168,188,

Patent Document 2: U.S. Pat. No. 4,245,698,

Patent Document 3: International Patent Publication Pamphlet No. WO 03/044239,

Patent Document 4: Japanese Laid-Open Patent Publication No. 11-302801,

Patent Document 5: Japanese Laid-Open Patent Publication No. 2000-301212,

Non-Patent Document 1: Tomio YAMAKAWA and Chihiro HAYASHI: CAMP-ISIJ, Vol. 6 (1993), 364.

DISCLOSURE OF THE INVENTION

Problems to be Solved by the Invention

An alloy with Mo content of not more than 1.5% in the Patent Document 4 among the alloys proposed in the Patent Documents 1 to 4, that is to say, the alloy with Mo content of not more than 1.5% among the "high Cr-high Ni alloys, excellent in stress corrosion cracking resistance" containing 20 to 35% of Cr and 25 to 50% of Ni, which are proposed as materials for oil wells and gas wells, has high hot workability, and causes no flaws and cracks even if pierced and rolled by a piercer. Therefore, if this alloy is used as a steel stock, a pipe stock for an alloy pipe can be manufactured with high productivity. Consequently, this alloy can be used as a material for oil wells and gas wells due to its extremely excellent economical properties.

However, the corrosion resistance of this alloy is not necessarily satisfactory in an environment in which carbon dioxide partial pressure is raised to, for example, about 1013250 to 2026500 Pa (10 to 20 atm) because of the Mo content as low as not more than 1.5%, although it does have satisfactory corrosion resistance in an environment in which the hydrogen sulfide partial pressure of 101325 to 1013250 Pa (1 to 10 atm), a temperature of 150 to 250° C., and a carbon dioxide partial pressure of about 709275 Pa (7 atm).

On the other hand, the Ni base alloys and super austenitic stainless alloys simultaneously containing Mo and/or W in large quantities, such a value represented by the equation of Mo (%)+0.5W (%) exceeds 1.5% (hereinafter referred also to as "Mo equivalent value"), in addition to high contents of both Cr and Ni, which are proposed in the Patent Documents 1 to 3, are excellent in corrosion resistance in a severe sour gas environment but too low in hot workability, so that the piercing and rolling by a piercer thereof inevitably involved flaws or cracks in the past.

Similarly, among the high Cr-high Ni alloys containing 20 to 35% of Cr and 25 to 50% of Ni, which are proposed in the Patent Document 4, an alloy with a Mo content exceeding 1.5% (hereinafter also referred to "Mo equivalent value exceeding 1.5%) is excellent in corrosion resistance in a severe sour gas environment, but too low in hot workability, so that the piercing and rolling by a piercer thereof inevitably involved flaws or cracks in the past.

That is to say, in the manufacturing of pipe stocks of austenitic materials by piercing and rolling with a piercer, inside surface flaws or two-piece cracks resulting from fusion remarkably occurred even when using austenitic stainless steels such as SUS 316, SUS 321 and SUS 347 regulated by JIS as steel stocks. Accordingly, when an austenitic alloy simultaneously containing Mo and W in large quantities exceeding 1.5% in terms of Mo equivalent value, in addition to high contents of Cr and Ni, which is further harder to work than the above-mentioned austenitic stainless steels, is pierced and rolled with a piercer by the general method, the occurrence of flaws or cracks could not be avoided as described above.

Consequently, the said pipe stocks for high-strength, high-corrosion resistance seamless pipes for oil wells and gas wells of various high Cr-high Ni alloys, with Mo equivalent value exceeding 1.5%, which have extremely satisfactory corrosion resistance in the sour gas environment, have been ordinarily manufactured by a hot extrusion process such as the Ugine-Sejournet method.

However, the hot extrusion process is not suitable for a manufacturing of pipe stocks for large diameter pipes or sufficiently long pipes. The pipe stocks manufactured by the hot extrusion process, such as the Ugine-Sejournet method, consequently could not respond to industrial demands for increased productivity of oil or gas and also meet the low cost of manufacturing alloy pipes to be used in oil wells and gas wells.

The pipe stocks for large diameter pipes or sufficiently long pipes can be manufactured, for example, by hot forging using a transverse press. However, the alloys which have high contents of both Cr and Ni and simultaneously containing Mo and W in large quantities exceeding 1.5% in terms of Mo equivalent value, are hard-to-work materials with extremely low hot workability, and so, the forgeable temperatures thereof are limited to a narrow range. Therefore, the industrial mass production of the pipe stocks for large diameter pipes or sufficiently long pipes by hot forging using these alloys is also problematic because of the necessity of repetition of heating and forging and the resulting extremely poor productivity and yield.

Accordingly, for various alloys having high contents of both Cr and Ni, simultaneously containing Mo and W in large quantities exceeding 1.5% in terms of Mo equivalent value and having extremely satisfactory corrosion resistance in the sour gas environment, it is highly demanded to efficiently manufacture pipe stocks for the large diameter pipes or sufficiently long pipes by piercing and rolling with a piercer at a low cost on an industrial scale, similarly to the cases of carbon steels and low alloy steels, and further martensitic stainless steels such as so-called "13%-Cr steel".

However, the "hard-to-work materials", which are intended by the method for piercing with a piercer proposed by the Patent Document 5, are simply those lower in the deformation resistance than the stainless steels as described in paragraph [0004] thereof. Therefore, the above-mentioned high Cr-high Ni austenitic alloys simultaneously containing Mo and W in large quantities, exceeding 1.5% in terms of Mo equivalent value, with respect to Ni, Mo and W each of which is an element increasing the deformation resistance, particularly, the austenitic alloys, including not less than 15% Cr and more than 45% Ni and further simultaneously containing Mo and W in large quantities, exceeding 1.5% in terms of Mo equivalent value, are not taken into account by the said method in the Patent Document 5. Further, the said method for piercing with a piercer only comprises adjusting a billet heating temperature in association with a piercing rate by a piercer, thereby performing piercing and rolling while controlling the billet internal temperature to be lower than an overheat temperature.

The "overheat temperature" intended by the method for piercing with a piercer of the Patent Document 5 is 1260 to 1310° C. The "overheat temperature" means a temperature at which the material causes intergranular fusion. In order to apply the method for piercing with a piercer, as shown in FIG. 5 of the Patent Document 5, even to a material lower in deformation resistance than a stainless steel, it is necessary to control the billet heating temperature to 1180° C. maximum, which is lower than that in the conventional rolling of a carbon steel, a low alloy steel and a martensitic stainless steel. Similarly, as shown in FIG. 5 of the same, the piercing rate is also 300 mm/sec maximum, and must be reduced to about a half or less of the conventional one even in the case of the highest 300 mm/sec. For example, manufacturing of a pipe stock of 8 m length requires about 27 seconds which is about twice the conventional one.

In the technique disclosed by the Patent Document 5, the billet heating temperature must be adjusted in association with the piercing rate by a piercer to prevent the billet inner part from being heated to the overheat temperature or higher during piercing and rolling. For example, as shown in the said FIG. 5, if the billet heating temperature is raised to about 1180° C., the piercing rate must be set to an extremely low condition of about 50 mm/sec, which cannot be endured through the industrial mass production. If the piercing rate is set to about 300 mm/sec, the manufacturing can be performed with efficiency at about half the conventional one as described above, but the billet heating temperature, as shown in the said FIG. 5, must be set to an extremely low temperature of about 1060° C. Therefore, the manufacturing of pipe stocks of austenitic alloys with high deformation resistance which include not less than 15% Cr and more than 45% Ni and further simultaneously contains Mo and W in large quantities exceeding 1.5% in terms of Mo equivalent value, needs a piercing performance far more than that of a general piercer, and thus needs an extremely large power source for the piercer.

The technique disclosed in the Non-Patent Document 1 describes, concretely, that rolling can be performed without inside surface scabs or two-piece cracks by setting the roll cross angle to not less than 10° and the roll feed angle to not less than 14° in the piercing of a 25Cr-35Ni-3Mo alloy and a 30Cr-40Ni-3Mo alloy, and by setting the roll feed angle to not less than 16° with a roll cross angle of 10° or setting the roll feed angle to not less than 14° with a roll cross angle of 15° in the piercing of a 25Cr-50Ni-6Mo alloy.

However, a general piercer used in a seamless steel pipe manufacturing factory, which has been built for the purpose of piercing and rolling carbon steels and low alloy steels, and further martensitic stainless steels such as so-called "13%-Cr steel", has a roll cross angle of about 0 to 10° and a roll feed angle of about 7 to 14°.

Accordingly, the replacement of the piercer to having a large roll cross angle and roll feed angle as proposed in the Non-Patent Document 1 for the purpose of piercing and rolling of a high Cr-high Ni alloy necessitates a huge cost, and is not realistic.

Consequently, the piercing and rolling by a piercer of pipe stocks for large diameter and sufficiently long pipes of austenitic Ni base alloys including not less than 15% Cr and more than 45% Ni and further simultaneously containing Mo and W in large quantities, exceeding 1.5% in terms of Mo equivalent value, has never been performed on an industrial mass production scale.

In other words, there are no pipe stocks obtained by the piercing and rolling the austenitic Ni base alloys including not less than 15% Cr and more than 45% Ni and further simultaneously containing Mo and W in large quantities exceeding 1.5% in terms of Mo equivalent value on an industrial mass production scale.

In order to solve the above-mentioned problems, the present inventors made detailed examinations for the occurrence state of inside surface flaws in the piercing and rolling by a piercer of hard-to-work Ni base alloys of high Cr-high Ni series, particularly, austenitic Ni base alloys including not less than 15% Cr and more than 45% Ni and further simultaneously containing Mo and W in large quantities exceeding 1.5% in terms of Mo equivalent value, from the point of microstructure change of the materials. As the result, the following findings (a) to (d) were obtained.

(a) Inside surface fracture flaws caused in the Ni base alloys of high Cr-high Ni series can be roughly classified into three groups as follows:

(1) Two-piece cracks resulting from the intergranular fusion involved by work heat generation on the high temperature side;

(2) Inside surface scabs resulting from high deformation resistance; and, (3) Inside surface cracks and scabs on both the inside and outside surface resulting from the sigma phase formation in a low temperature region caused by a drop in temperature.

(b) The two-piece cracks resulting from the intergranular fusion of the above-mentioned (1) is remarkable when solidification segregation of elements which comprise the material to be pierced and rolled, particularly, the solidification segregation of C, P and S, is present. The solidification segregation state of C, P and S which greatly depends on the composition balance of Fe, Ni, Cr, Mo and the like, namely, the state of the intergranular fusion can be evaluated by the value of $T_{GBm}$ represented by the following equation (1) in the austenitic Ni base alloys, including not less than 15% Cr and more than 45% Ni, and further simultaneously containing Mo and W in large quantities exceeding 1.5% in terms of Mo equivalent value. When the value of $T_{GBm}$ is not less than 1300 piercing and rolling property is enhanced, and so, the two-piece cracks can be suppressed in the piercing and rolling by a piercer:

$$T_{GBm}=1380-5000P-100S-4400C \quad (1).$$

(c) The deformation resistance in hot working of the material changes mainly depending on the contents of Ni, N, Mo and W, and a material with higher deformation resistance more likely causes the inside surface scabs of above-mentioned (2). The occurrence state of the said inside surface scabs can be evaluated by the value of $P_{sr}$ represented by the following equation (2) in the austenitic Ni base alloys, including not less than 15% Cr and more than 45% Ni, and further simultaneously containing Mo and W in large quantities exceeding 1.5% in terms of Mo equivalent value. When the value of $P_{sr}$ is not more than 200, the inside surface scabs can be suppressed in the piercing and rolling by a piercer:

$$P_{sr}=Ni+10(Mo+0.5W)+100N \quad (2).$$

(d) When a billet temperature falls, among the elements which comprise the material to be pierced and rolled, the composition balance of Ni, N, Cr, Mo and W mainly has great influence on the formation of the sigma phase. In the said austenitic Ni base alloys including not less than 15% Cr and more than 45% Ni, and further simultaneously containing Mo and W in large quantities, exceeding 1.5% in terms of Mo equivalent value, the inside surface cracks and the scabs on both the inside and outside surface resulting from the formation of the sigma phase of the above-mentioned (3) are remarkable when the sigma phase is formed at 1000° C. The said inside surface cracks and the said scabs on both the inside and outside surface can be evaluated by the value of $P_\sigma$ represented by the following equation (3). When the value of $P_\sigma$ is not less than 0, the said inside surface cracks and the said scabs on both the inside and outside surface can be suppressed in the piercing and rolling by a piercer:

$$P_\sigma=(Ni-50)+10(N-0.1)-2(Cr-25)-5(Mo+0.5W-6)+12 \quad (3).$$

Each element symbol in the above equations (1) to (3) represents the content by mass % of the element concerned.

The present inventors further made various examinations for the conditions of the piercing and rolling billets of the austenitic Ni base alloys including not less than 15% Cr and more than 45% Ni and further simultaneously containing Mo and W in large quantities exceeding L5% in terms of Mo equivalent value, by a piercer. As a result, the following findings (e) and (f) were obtained.

(e) In the austenitic Ni-base alloys in which upper limit values of the contents of C, P and S are controlled to 0.04%, 0.03% and 0.01%, respectively, the value of $T_{GBm}$ represented by the said equation (1) is set to not less than 1300, the two-piece cracks resulting from the intergranular fusion can be easily suppressed by increasing a pipe expansion ratio H represented by the ratio of an outer diameter of a pipe stock to a diameter of a steel stock billet.

(f) In addition to the condition of the above-mentioned (e), the value of fn represented by the following equation (4), that is a relational equation of the pipe expansion ratio H and contents of P and S contained in a Ni base alloy is set to not more than 0.3, whereby the two-piece cracks resulting from the intergranular fusion in the piercing and rolling by a piercer can be perfectly prevented:

$$fn=\{P/(0.025H-0.01)\}^2+\{S/(0.015H-0.01)\}^2 \quad (4).$$

In the above equation (4), P and S represent the contents, by mass %, of P and S in a pipe stock, respectively, and H represents the pipe expansion ratio represented by the ratio of the outer diameter of a pipe stock to the diameter of a steel stock billet.

The present invention has been accomplished on the basis of the above-mentioned findings. It is an objective of the present invention to provide Ni base alloy pipe stocks of high Cr-high Ni series simultaneously containing Mo and W in large quantities exceeding 1.5% in terms of Mo equivalent value, and pierced and rolled by a piercer, which have excellent corrosion resistance in a sour gas environment in addition to excellent mechanical properties, such as strength and ductility, and manufacturing methods thereof, particularly, Ni base alloy pipe stocks, including not less than 15% Cr and more than 45% Ni, and further simultaneously containing Mo and W in large quantities, exceeding 1.5% in terms of Mo equivalent value, and manufacturing methods thereof. It is another objective of the present invention to provide Ni base alloy seamless pipes, excellent in mechanical properties and the corrosion resistance in a sour gas environment, which are manufactured using the above-mentioned pipe stocks.

Means for Solving the Problem

The gists of the present invention are Ni base alloy pipe stocks shown in the following (1) to (7), methods for manufacturing Ni base alloy pipe stocks shown in (8) and (9), and a Ni base alloy seamless pipe shown in (10).

(1) A Ni base alloy pipe stock, having a chemical composition comprising, by mass %, C: not more than 0.04%, Si: not more than 0.50%, Mn: 0.01 to 6.0%, P: not more than 0.03%, S: not more than 0.01%, Cr: 15 to 30%, Ni: more than 45% to not more than 60%, Mo: 0 to 18%, W: 0 to 36%, with Mo (%)+0.5W (%): more than 1.5% to not more than 18%, Cu: 0.01 to 1.5%, Al: not more than 0.10% and N: 0.0005 to 0.20%, and the balance being substantially Fe, with values of $T_{GBm}$, $P_{sr}$ and $P_{\sigma}$ represented by the following equations (1) to (3) being not less than 1300, not more than 200, and not less than 0, respectively, and moreover being subjected to piercing and rolling by a Mannesmann piercing and rolling mill:

$$T_{GBm}=1380-5000P-100S-4400C \quad (1),$$

$$P_{sr}=Ni+10(Mo+0.5W)+100N \quad (2),$$

$$P_{\sigma}=(Ni-50)+10(N-0.1)-2(Cr-25)-5(Mo+0.5W-6)+12 \quad (3),$$

wherein each element symbol in the equations (1) to (3) represents the content by mass % of the element concerned.

(2) The Ni base alloy pipe stock according to the above (1), wherein Mn is 0.01 to 1.0%.

(3) A Ni base alloy pipe stock according to the above (1) or (2), which further contains one or more elements selected from among V: 0.001 to 0.3%, Nb: 0.001 to 0.3%, Ta: 0.001 to 1.0%, Ti: 0.001 to 1.0%, Zr: 0.001 to 1.0% and Hf: 0.001 to 1.0% in lieu of part of Fe.

(4) A Ni base alloy pipe stock according to any one of the above (1) to (3), which further contains B: 0.0001 to 0.015% in lieu of part of Fe.

(5) A Ni base alloy pipe stock according to any one of the above (1) to (4), which further contains Co: 0.3 to 5.0% in lieu of part of Fe.

(6) A Ni base alloy pipe stock according to any one of the above (1) to (5), which further contains one or more elements selected from among Mg: 0.0001 to 0.010%, Ca: 0.0001 to 0.010%, La: 0.0001 to 0.20%, Ce: 0.0001 to 0.20%, Y: 0.0001 to 0.40%, Sm: 0.0001 to 0.40%, Pr: 0.0001 to 0.40% and Nd: 0.0001 to 0.50% in lieu of part of Fe.

(7) The Ni base alloy pipe stock according to any one of the above (1) to (6), which has the chemical composition according to any one of the said (1) to (6), with the value of fn represented by the following equation (4) being not more than 0.3:

$$fn=\{P/(0.025H-0.01)\}^2+\{S/(0.015H-0.01)\}^2 \quad (4),$$

wherein P and S represent contents, by mass %, of P and S in the pipe stock, respectively, and H represents the pipe expansion ratio represented by the ratio of the outer diameter of the pipe stock to the diameter of a steel stock billet.

(8) A method for manufacturing a Ni base alloy pipe stock, comprising piercing and rolling a billet, which satisfies the chemical compositions according to any one of the above (1) to (6), by use of a Mannesmann piercing and rolling mill.

(9) The method for manufacturing a Ni base alloy pipe stock according to the above (8), wherein the piercing and rolling by the Mannesmann piercing and rolling mill is performed in a condition where the value of fn represented by the following equation (4) is not more than 0.3:

$$fn=\{P/(0.025H-0.01)\}^2+\{S/(0.015H-0.01)\}^2 \quad (4),$$

wherein P and S represent contents, by mass %, of P and S in the pipe stock, respectively, and H represents the pipe expansion ratio represented by the ratio of the outer diameter of the pipe stock to the diameter of the steel stock billet.

(10) A Ni base alloy seamless pipe, manufactured by use of the Ni base alloy pipe stock according to any one of the above (1) to (7) or by use of the Ni base alloy pipe stock manufactured by the method according to the above (8) or (9).

The above-mentioned inventions (1) to (7) related to the Ni base alloy pipe stocks, inventions (8) and (9) related to the methods for manufacturing a Ni base alloy pipe stock, and the invention (10) related to the Ni base alloy seamless pipe are referred to as "the present invention (1)" to "the present invention (10)", respectively, or collectively referred to as "the present invention".

Effect of the Invention

Oil country tubular goods and line pipes and various structural members of nuclear power plants and chemical industrial plants, which are manufactured using the Ni base alloy pipe stocks of the present invention as steel stocks are excellent in corrosion resistance in a sour gas environment, and also have excellent mechanical properties such as strength and ductility. Therefore, the Ni base alloy pipe stocks of the present invention can be used as pipe stocks for oil country tubular goods and line pipes, and also can be used as pipe stocks for various structural members of nuclear power plants and chemical industrial plants. Further, since the Ni base alloy pipe stocks of the present invention are obtained by piercing and rolling with a piercer, large diameter pipes or sufficiently long pipes can be easily manufactured using them as steel stocks, and the industrial demand for high-efficiency and low cost development of oil wells and gas wells can be sufficiently satisfied.

BEST MODE FOR CARRYING OUT THE INVENTION

All of the requirements of the present invention will next be described in detail.

(A) Chemical Composition of Ni Base Alloy

In the following description, the symbol "%" for the content of each element represents "% by mass".

C: not more than 0.04%

An excessive content of C remarkably increases the amount of $M_{23}C_6$ type carbides, resulting in a deterioration of ductility and toughness of the alloy. Particularly, a content of C exceeding 0.04% causes a remarkable deterioration of ductility and toughness. Therefore, the content of C is set to not more than 0.04%. The content of C is preferably reduced to 0.02% or less. When the content of C is controlled to 0.010% or less, not only the ductility and toughness but also the corrosion resistance can be remarkably improved.

The "M" in the "$M_{23}C_6$ type carbides" means metal elements such as Mo, Fe, Cr, W and the like in combination.

A high content of C causes solidification segregation which reduces the intergranular fusion temperature of the Ni base alloy, resulting in a deteriorated piercing and rolling property by a piercer. Therefore, the content of C must be set to an amount in which the value of $T_{GBm}$ represented by the said equation (1) satisfies not less than 1300 from the balance with contents of P and S described later.

Si: not more than 0.50%

Excessive Si promotes the formation of the sigma phase, causing a deterioration of ductility and toughness. Particularly, a content of Si exceeding 0.50% makes it difficult to suppress the inside surface cracks and the scabs on both the inside and outside surface resulting from the sigma phase formation in the piercing and rolling by a piercer even if the value of $P_\sigma$ represented by the said equation (3) is not less than 0. Therefore, the content of Si is set to not more than 0.50%. If the content of Si is reduced to 0.10% or less, the grain boundary precipitation of the carbides can be suppressed to largely improve the ductility, toughness and corrosion resistance.

Mn: 0.01 to 6.0%

Mn has a desulfurizing effect. In order to ensure this effect, the content of Mn must be set to not less than 0.01%. However, a content of Mn exceeding 6.0% promotes the formation of the $M_{23}C_6$ type carbides, and so, the corrosion resistance may be deteriorated. Therefore, the content of Mn is set to 0.01 to 6.0%. A content of Mn exceeding 1.0% promotes the formation of the sigma phase, and may cause the inside surface cracks and the scabs on both the inside and outside surface resulting from the sigma phase formation in piercing and rolling by a piercer even if the value of $P_\sigma$ represented by the said equation (3) is not less than 0. Accordingly, the content of Mn is set more preferably to 0.01 to 1.0% and further more preferably to 0.01 to 0.50%.

P: not more than 0.03%

P is an impurity which is generally inevitably included. If it is present in an alloy in large quantities, not only the hot workability but also the corrosion resistance generally deteriorates. Particularly, a content of P exceeding 0.03% makes a remarkable deterioration of hot workability and corrosion resistance. Therefore, the content of P is set to not more than 0.03%. The content of P is set further preferable to not more than 0.01%.

Since a high content of P causes solidification segregation, the intergranular fusion temperature of the Ni base alloy falls, and this results in a deterioration of the piercing and rolling property by a piercer. Therefore, the content of P must be set to an amount in which the value of $T_{GBm}$ represented by the said equation (1) satisfies not less than 1300 from the balance with the content of C described above and the content of S described below.

S: not more than 0.01%

S is also an impurity which is generally inevitably included. If it is present in an alloy in large quantities, not only the hot workability but also the corrosion resistance generally deteriorates. Particularly, a content of S exceeding 0.01% makes a remarkable deterioration of hot workability and corrosion resistance. Therefore, the content of S is set to not more than 0.01%. The content of S is set more preferably to not more than 0.005%.

Since a high content of S causes solidification segregation, the intergranular fusion temperature of the Ni base alloy falls, and this results in a deterioration of the piercing and rolling property by a piercer. Therefore, the content of S must be set to an amount in which the value of $T_{GBm}$ represented by the said equation (1) satisfies not less than 1300 from the balance with the contents of C and P described above.

Cr: 15 to 30%

Cr, with Mo, W and N, has the effect of improving the corrosion resistance and strength of an alloy. This effect can be remarkably obtained with a content of Cr of not less than 15%. However, if the content of Cr exceeds 30%, the hot workability of the alloy deteriorates. Therefore, the content of Cr is set to 15 to 30%. The content of Cr is set more preferably to 21 to 27%.

In the present invention, in order to suppress the inside surface cracks and the scabs on both the inside and outside surface resulting from the sigma phase formation, the content of Cr must be set to an amount in which the value of $P_\sigma$ represented by the said equation (3) satisfies not less than 0 from the balance with the contents of Ni, Mo, W and N described later.

Ni: more than 45% to not more than 60%

Ni, with N, has the effect of stabilizing the austenite matrix, and it is an essential element for including elements having a strengthening effect and a corrosion resisting effect such as Cr, Mo and W in the Ni base alloy. Ni also has an effect of suppressing the formation of the sigma phase. Each of the effects described above can be easily obtained when the content of Ni exceeds 45%. On the other hand, a large amount of additional Ni causes an excessive increase of alloy cost, and if the content of Ni exceeds 60%, the cost extremely increases. Therefore, the content of Ni is set to more than 45% to not more than 60%. The content of Ni is set more preferably to 50 to 60%.

In the present invention, in order to suppress the excessive rise of deformation resistance and to suppress the inside surface scabs, the content of Ni must be set to an amount in which the value of $P_{sr}$ represented by the said equation (2) satisfies not more than 200 from the balance with the contents of Mo, W and N described later. In order to suppress the inside surface cracks and the scabs on both the inside and outside surface resulting from the sigma phase formation, the content of Ni must be set to an amount in which the value of $P_a$ represented by the said equation (3) satisfies not less than 0 from the balance with the content of Cr described above and the contents of Mo, W and N described later.

Mo: 0 to 18%, W: 0 to 36%, Mo (%)+0.5W (%): more than 1.5% to not more than 18%

Both Mo and W have the effect of enhancing the strength of an alloy in coexistence with Cr, and further the effect of remarkably improving corrosion resistance, particularly, pitting resistance. In order to ensure these effects, Mo and/or W must be included in an amount exceeding 1.5% in terms of value represented by the expression Mo (%)+0.5W (%), namely, in terms of Mo equivalent value. However, a Mo equivalent value exceeding 18% causes a significant deterioration of mechanical properties such as ductility and toughness. Mo and W do not need a composite addition, and can be added simply so that the Mo equivalent value is within the above range. Therefore, the content of Mo is set to 0 to 18%, and the content of W is set to 0 to 36%, and the value of Mo (%)+0.5W (%) is set to more than 1.5% to not more than 18%.

In the present invention, in order to suppress the excessive rise of deformation resistance to suppress the inside surface scabs, the contents of Mo and W and the Mo equivalent value must be set to amounts so that the value of $P_{sr}$ represented by the said equation (2) satisfies not more than 200 from the balance with the content of Ni described above and the content of N described later. In order to suppress the inside surface cracks and the scabs on both the inside and outside surface resulting from the sigma phase formation, the contents of Mo and W and the Mo equivalent value must be set to amounts so that the value of $P_\sigma$ represented by the said equation (3) satisfies not less than 0 from the balance with the contents of Cr and Ni described above and the content of N described later.

Cu: 0.01 to 1.5%

Cu is an element effective for improving the corrosion resistance in a sour gas environment and, particularly, it has the effect of highly enhancing the corrosion resistance, in coexistence with Cr, Mo and W in a sour gas environment where S (sulfur) is observed as a separated element. This effect is obtained with a content of Cu of not less than 0.01%. However, a content of Cu exceeding 1.5% may cause a deterioration of ductility and toughness. Therefore, the content of Cu is set to 0.01 to 1.5%. The content of Cu is set more preferably to 0.5 to 1.0%.

Al: not more than 0.10%

Al is the most harmful element which promotes the formation of the sigma phase. Particularly, a content of Al exceeding 0.10% makes it difficult to suppress the inside surface cracks and the scabs on both the inside and outside surface resulting from the sigma phase formation in the piercing and rolling by a piercer even if the value $P_o$ represented by the said equation (3) is not less than 0. Therefore, the content of Al is set to not more than 0.10%. The content of Al is set more preferably to not more than 0.06%.

N: 0.0005 to 0.20%

N is one of important elements in the present invention, and with Ni, it has the effect of stabilizing the austenite matrix and the effect of suppressing the formation of the sigma phase. The above-mentioned effects can be obtained with a content of N of not less than 0.0005%. However, excessive addition of N may cause a deterioration of toughness, and particularly a content exceeding 0.20% may cause a remarkable deterioration of toughness. Therefore, the content of N is set to 0.0005 to 0.20%. The content of N is set more preferably to 0.0005 to 0.12%.

In the present invention, in order to suppress the excessive rise of deformation resistance and to suppress the inside surface scabs, the content of N must be set to an amount in which the value of $P_{sr}$ represented by the said equation (2) satisfies not more than 200 from the balance with the contents of Ni, Mo and W described above. Moreover, in order to suppress the inside surface cracks and the scabs on both the inside and outside surface resulting from the sigma phase formation, the content of N must be set to an amount in which the value of $P_o$ represented by the said equation (3) satisfies not less than 0 from the balance with the contents of Cr, Ni, Mo and W described above.

Fe: substantial balance

Fe has the effect of ensuring the strength of an alloy and also reducing the content of Ni in order to decrease the cost of the alloy. Therefore, in the alloys of steel stocks for the Ni base alloy pipe stocks of the present invention, a substantial balance of the element Fe is included.

Value of $T_{GBm}$: not less than 1300

As described above, among the inside surface flaws which are present in the Ni base alloys of the high Cr-high Ni series, the two-piece cracks resulting from the intergranular fusion involved by work heat generation on the high temperature side is remarkable, when the solidification segregation of elements which comprise the material to be pierced and rolled, particularly the solidification segregation of C, P and S is present. In the austenitic Ni base alloys, including not less than 15% Cr and more than 45% Ni, and further simultaneously containing Mo and W in large quantities, exceeding 1.5% in terms of Mo equivalent value, the state of the intergranular fusion can be evaluated by the value of $T_{GBm}$, represented by the said equation (1). When the value of $T_{GBm}$ is not less than 1300, the two-piece cracks can be suppressed in the piercing and rolling by a piercer, therefore, the value of $T_{GBm}$ is set to not less than 1300. The value of $T_{GBm}$ is set more preferably to not less than 1320.

Value of $P_{sr}$: not more than 200

As described above, among the inside surface flaws which are present in the hard-to-work Ni base alloys of the high Cr-high Ni series, particularly in the austenitic Ni base alloys, including not less than 15% Cr and more than 45% Ni, and further simultaneously containing Mo and W in large quantities, exceeding 1.5% in terms of Mo equivalent value, the inside surface scabs resulting from high deformation resistance can be evaluated by the value of $P_{sr}$, represented by the said equation (2). When the value of $P_{sr}$ is not more than 200, the inside surface scabs can be suppressed in the piercing and rolling by a piercer, therefore, the value of $P_{sr}$ is set to not more than 200. The value of $P_{sr}$ is set more preferably to not more than 150.

Value of $P_o$: not less than 0

Among the inside surface flaws which are present in the Ni base alloys of the high Cr-high Ni series, particularly, in the austenitic Ni base alloys, including not less than 15% Cr and more than 45% Ni, and further simultaneously containing Mo and W in large quantities, exceeding 1.5% in terms of Mo equivalent value, the inside surface cracks and the scabs on both the inside and outside surface resulting from the sigma phase formation in a low temperature region involved by a temperature drop can be evaluated by the value of $P_o$, represented by the said equation (3). When the value of $P_o$ is not less than 0, the inside surface cracks and the scabs on both inside and outside surface can be suppressed in the piercing and rolling by a piercer, therefore, the value of $P_o$ is set to not less than 0. The value of $P_o$ is set more preferably to not less than 3.0.

Accordingly, the chemical compositions of the alloy as the steel stock for the Ni base alloy pipe stock of the present invention (1) was regulated to include elements of from C to N in the above-mentioned ranges, and the balance substantially being Fe, with the value of $T_{GBm}$ being not less than 1300, the value of $P_{sr}$ being not more than 200, and the value of $P_o$ being not less than 0.

In the Ni base alloy pipe stock of the present invention (2), the content of Mn is particularly regulated from 0.01 to 1.0% in the composition of alloy as the steel stock for the Ni base alloy pipe stock of the present invention (1).

The alloys as steel stocks for the Ni base alloy pipe stocks of the prevent invention can selectively contain, in addition to the above-mentioned components, one or more of elements of each group described below as occasion demands:

(i) One or more elements selected from among V: 0.001 to 0.3%, Nb: 0.001 to 0.3%, Ta: 0.001 to 1.0%, Ti: 0.001 to 1.0%, Zr: 0.001 to 1.0% and Hf: 0.001 to 1.0%;

(ii) B: 0.0001 to 0.015%;

(iii) Co: 0.3 to 5.0%; and (iv) One or more elements selected from among Mg: 0.0001 to 0.010%, Ca: 0.0001 to 0.010%, La: 0.0001 to 0.20%, Ce: 0.0001 to 0.20%, Y: 0.0001 to 0.40%, Sm: 0.0001 to 0.40%, Pr: 0.0001 to 0.40% and Nd: 0.0001 to 0.50%. That is to say, one or more elements of the four groups (i) to (iv) can be added thereto as optional additive elements.

The optional additive elements are described as follows:

(i) V: 0.001 to 0.3%, Nb: 0.001 to 0.3%, Ta: 0.001 to 1.0%, Ti: 0.001 to 1.0%, Zr: 0.001 to 1.0% and Hf: 0.001 to 1.0%

Each of V, Nb, Ta, Ti, Zr and Hf, if added, has the effect of remarkably enhancing the corrosion resistance in a sour gas environment where S (sulfur) is observed as a separated element. Further, it forms MC type carbides (M means any one element of V, Nb, Ta, Ti, Zr and Hf or a combination thereof) to effectively stabilize C, and also has the effect of enhancing the strength.

In order to ensure the above-mentioned effects, the content of each element of V, Nb, Ta, Ti, Zr and Hf is preferably set to not less than 0.001%. However, if the contents of V and Nb exceed 0.3%, and the contents of Ta, Ti, Zr and Hf exceed 1.0%, their independent carbides are precipitated in large quantities, causing a deterioration of ductility and toughness.

Therefore, if V, Nb, Ta, Ti, Zr and Hf are added, the respective contents are preferably set to 0.001 to 0.3% for V, 0.001 to 0.3% for Nb, 0.001 to 1.0% for Ta, 0.001 to L0% for Ti, 0.001 to 1.0% for Zr, and 0.001 to 1.0% for Hf.

From the above reason, the chemical compositions of the alloy as the steel stock for the Ni base alloy pipe stock of the present invention (3) is regulated to contain, in lieu of part of Fe of the Ni base alloy in the present invention (1) or (2), one or more elements selected from among V: 0.001 to 0.3%, Nb: 0.001 to 0.3%, Ta: 0.001 to 1.0%, Ti: 0.001 to 1.0%, Zr: 0.001 to 1.0%, and Hf: 0.001 to 1.0%.

In the alloy as the steel stock for the Ni base alloy pipe stock of the present invention (3), further preferable content ranges of the elements, if added, are 0.10 to 0.27% for V, 0.03 to 0.27% for Nb, 0.03 to 0.70% for Ta, 0.03 to 0.70% for Ti, 0.03 to 0.70 for Zr, and 0.03 to 0.70% for Hf.

The above-mentioned V, Nb, Ta, Ti, Zr and Hf can be added alone or in combination of two or more thereof.

B: 0.0001 to 0.015%

B, if added, has the effect of refining precipitates and austenite grain size. In order to definitely obtain the said effect, the content of B is preferably set to not less than 0.0001%. However, excessive addition of B may cause a deterioration of hot workability by the formation of low melting point compounds, and a content thereof exceeding 0.015%, particularly, can make a remarkable deterioration of hot workability. Therefore, the content of B, if added, is preferably set to 0.0001 to 0.015%.

From the above reason, the chemical compositions of the alloy as the steel stock for the Ni base alloy pipe stock of the present invention (4) is regulated to contain B: 0.0001 to 0.015% in lieu of part of Fe of the Ni base alloy in any one of the present inventions (1) to (3).

In the alloy of the steel stock for the Ni base alloy pipe stock of the present invention (4), a further preferable content range of B, if added, is 0.0010 to 0.0050%.

(iii) Co: 0.3 to 5.0%

Co, if added, has the effect of stabilizing austenite. In order to ensure the said effect, the content of Co is preferably set to not less than 0.3%. However, excessive addition of Co causes excessive rise of alloy cost, and a content of Co exceeding 5.0%, particularly, makes the cost increase excessive, therefore, the content of Co, if added, is preferably set to 0.3 to 5.0%.

From the above reason, the chemical compositions of the alloy as the steel stock for the Ni base alloy pipe stock of the present invention (5) is regulated to contain Co: 0.3 to 5.0%, in lieu of part of Fe of the Ni base alloy in any one of the present inventions (1) to (4).

In the alloy of the steel stock for the Ni base alloy pipe stock of the present invention (5), a further preferable content range of Co, if added, is 0.35 to 4.0%.

(iv) Mg: 0.0001 to 0.010%, Ca: 0.0001 to 0.010%, La: 0.0001 to 0.20%, Ce: 0.0001 to 0.20%, Y: 0.0001 to 0.40%, Sm: 0.0001 to 0.40%, Pr: 0.0001 to 0.40% and Nd: 0.0001 to 0.50%

Each of Mg, Ca, La, Ce, Y, Sm, Pr and Nd, if added, has the effect of preventing solidification cracks in ingot casting. They also have the effect of suppressing a deterioration of ductility after a long-term use.

In order to ensure the above effects, the content of each element of Mg, Ca, La, Ce, Y, Sm, Pr and Nd is set preferably to not less than 0.0001%. However, when the contents of Mg and Ca exceed 0.010%, the contents of La and Ce exceed 0.20%, the contents of Y, Sm and Pr exceed 0.40%, or the content of Nd exceeds 0.50%, coarse inclusions are produced, causing a deterioration of toughness.

Therefore, the contents of Mg, Ca, La, Ce, Y, Sm, Pr and Nd, if added, are preferably set to 0.0001 to 0.010% for Mg, 0.0001 to 0.010% for Ca, 0.0001 to 0.20% for La, 0.0001 to 0.20% for Ce, 0.0001 to 0.40% for Y, 0.0001 to 0.40% for Sm, 0.0001 to 0.40% for Pr, and 0.0001 to 0.50% for Nd.

From the above reason, the chemical compositions of the alloy as the steel stock for the Ni base alloy pipe stock of the present invention (6) is regulated to contain, in lieu of part of Fe of the Ni base alloy in any one of the present inventions (1) to Invention (5), one or more elements selected from among Mg: 0.0001 to 0.010%, Ca: 0.0001 to 0.010%, La: 0.0001 to 0.20%, Ce: 0.0001 to 0.20%, Y: 0.0001 to 0.40%, Sm: 0.0001 to 0.40%, Pr: 0.0001 to 0.40%, and Nd: 0.0001 to 0.50%.

In the alloy of the steel stock for the Ni base alloy pipe stock of the present invention (6), preferable content ranges of the elements, if added, are 0.0010 to 0.0050% for Mg, 0.0010 to 0.0050% for Ca, 0.01 to 0.15% for La, 0.01 to 0.15% for Ce, 0.01 to 0.15% for Y, 0.02 to 0.30% for Sm, 0.02 to 0.30% for Pr and 0.01 to 0.30% for Nd.

The above-mentioned Mg, Ca, La, Ce, Y, Sm, Pr and Nd can be added alone or in combination of two or more thereof.

Oil country tubular goods and line pipes and various structural members of nuclear power plants and chemical industrial plants, which are manufactured using the Ni base alloy pipe stocks having the chemical compositions described above as steel stocks are excellent in corrosion resistance in a sour gas environment, and also have excellent mechanical properties such as strength and ductility. Therefore, when the Ni base alloy pipe stocks, having the above-mentioned chemical compositions are applied to pipe stocks for oil country tubular goods and line pipes, and also to pipe stocks for various structural members of nuclear power plants and chemical industrial plants, significant durability and safety can be improved. That is to say, that Ni base alloy pipe stocks are extremely favorable for the use of members which are exposed in the above-mentioned environment.

(B) Manufacturing Method of the Ni Base Alloy Pipe Stock

Not only to obtain pipe stocks for various members which are excellent in mechanical properties such as strength and ductility, and also have excellent corrosion resistance in a sour gas environment, but also to satisfy the industrial demand for high-efficiency and low cost development of oil wells and gas wells, industrial mass production of pipe stocks for large diameter pipes or sufficiently long pipes is needed. The piercing and rolling by a piercer is suitable for such industrial mass production of pipe stocks for large diameter pipes or sufficiently long pipes.

However, as already described, it has been difficult in the past to mass produce Ni base alloy pipe stocks, particularly Ni base alloy pipe stocks, including not less than 15% Cr and more than 45% Ni and simultaneously containing Mo and W in large quantities exceeding 1.5% in terms of Mo equivalent value, which are excellent in mechanical properties, such as strength and ductility, and in corrosion resistance in a sour gas environment and also suitable as steel stocks for oil country tubular goods and line pipes and various structural members of nuclear power plants and chemical industrial plants, by piercing and rolling with a piercer by the same method as in the case of carbon steels and low alloy steels and further martensitic stainless steels, such as so-called "13%-Cr steel" (hereinafter referred to as "general method"). This is attributable to the piercing and rolling by a piercer of such a high Cr-high Ni alloy with large Mo equivalent value by the general method inevitably causes the occurrence of flaws or cracks.

On the other hand, in the Ni base alloys having the chemical compositions described in the above (A), the contents of elements of from C to N are optimized, the value of $T_{GBm}$ represented by the said equation (1), the value of $P_{sr}$ represented by the said equation (2), and the value of $P_o$ represented by the said equation (3), which all have correlations with the two-piece cracks resulting from the intergranular fusion on the high temperature side in the piercing and rolling by a piercer, the inside surface scabs resulting from high deformation resistance, and the inside surface cracks and the scabs on both the inside and outside surface resulting from the sigma phase formation, are set to not less than 1300, to not more than 200, and to not less than 0, respectively. Therefore, billets of the Ni base alloys, having the chemical compositions described in the above (A), can be pierced and rolled with a piercer by the general method while preventing all of the two-piece cracks, the inside surface scabs, and the inside surface cracks and the scabs on both the inside and outside surface resulting from the sigma phase formation. Therefore, the pipe stocks which have satisfactory surface properties can be obtained.

Accordingly, the present invention (8) can respond to the industrial demand for industrial mass-production of large diameter pipes or sufficiently long pipes by piercing and rolling the billets of Ni base alloys, having the compositions described in the above (A), with a piercer. And the Ni base alloy pipe stocks according to the present inventions (1) to (6) are regulated to have the chemical compositions described in the above (A) and to be pierced and rolled by a piercer.

The pipe stocks manufactured by the method of the present invention (8), namely, the pipe stocks obtained by piercing and rolling the billets having the chemical compositions of the above (A) by a piercer have satisfactory surface properties in which all of the two-piece cracks, the inside surface scabs, and inside surface cracks and the scabs on both the inside and outside surface resulting from the sigma phase formation are suppressed. Therefore, the Ni base alloy pipe stocks of the present inventions (1) to (6) can sufficiently respond to the above-mentioned industrial demand.

The piercing and rolling by a piercer of the billets having the chemical compositions described in the above (A) can be performed by the general method.

That is to say, the piercing and rolling by a piercer can be performed in the same condition as in the case of carbon steels and low alloy steels, and further martensitic stainless steels such as so-called "13%-Cr steel". Concretely, for example, the piercing and rolling can be performed with a billet heating temperature of 1200 to 1300° C., a roll cross angle of 0 to 10°, a roll feed angle of 7 to 14°, a draft rate of 8 to 14%, and a plug tip draft rate of 4 to 7%.

The draft rate and the plug tip draft rate are represented by the following equations (5) and (6), respectively.

$$\text{Draft rate (\%)}=\{(\text{Diameter of the steel stock}-\text{Gauge space of the roll})/\text{Diameter of the steel stock}\}\times 100 \quad (5),$$

$$\text{Plug tip draft rate (\%)}=\{(\text{Diameter of the steel stock}-\text{Roll gap at the foremost end of the plug})/\text{Diameter of the steel stock}\}\times 100 \quad (6).$$

As described above, the piercing and rolling by a piercer of the billets, having the chemical compositions described in the above (A), can be performed by the general method without providing any special conditions. However, as already described, the pipe expansion ratio H, represented by the ratio of an outer diameter of the pipe stock to a diameter of the steel stock billet, is increased whereby the two-piece cracks resulting from the intergranular fusion can be easily suppressed. Further, if the value of fn, presented by the said equation (4), is set to not more than 0.3, the two-piece cracks resulting from the intergranular fusion in the piercing and rolling by a piercer can be absolutely prevented, even in the case of Ni base alloys including not less than 15% Cr and more than 45% Ni and simultaneously containing Mo and W in large quantities exceeding 1.5% in terms of Mo equivalent value.

Therefore, in the present invention (9), the piercing and rolling by a piercer of billets of the Ni base alloys, having the chemical compositions described in the above (A), is performed with the value of fn represented by the said equation (4) being set to not more than 0.3. Also the Ni base alloy pipe stock of the present invention (7) is regulated to have the chemical composition described in the above (A) with the value of fn represented by the said equation (4) satisfying not more than 0.3, and also to be pierced and rolled by a piercer.

As described above, by increasing the value of the pipe expansion ratio H in the piercing and rolling by a piercer, the two-piece cracks resulting from the intergranular fusion can be easily suppressed. However, if the value of the pipe expansion ratio H exceeds 2, the phenomenon of the pipe stock becoming excessively swollen, and the steel stock protruding to a clearance between a roll and a disk or guide shoe, each of them is an outside surface regulating tool, and a fracture can be easily caused, resulting in rolling troubles. Therefore, the upper limit value of the pipe expansion ratio H is preferably set to 2. When the lower limit value of the pipe expansion ratio H is less than 1, a plug or a mandrel, each of them is a tool for inside surface working, must be reduced in the outer diameter, since the outer diameter of the resulting pipe stock becomes smaller than the diameter of the steel stock billet, which impractically causes erosion of the plug or curving of the mandrel, due to insufficient heat capacity.

(C) Ni Base Alloy Seamless Pipe

The Ni base alloy seamless pipe manufactured by use of the Ni base alloy pipe stock according to any one of the present inventions (1) to (7), or by use of the Ni base alloy pipe stock manufactured by the method of the present inventions (8) or (9) has satisfactory surface properties, and also is excellent in mechanical properties and in the corrosion resistance in a sour gas environment. Therefore, such seamless pipes are suitable to be used as oil country tubular goods or line pipes, and as various structural members of nuclear power plants and chemical industrial plants.

Therefore, in the present invention (10), the Ni base alloy seamless pipe is regulated to be manufactured using the Ni base alloy pipe stock, according to any one of the present inventions (1) to (7), or using the Ni base alloy pipe stock manufactured by the method of the present inventions (8) or Invention (9).

The Ni base alloy pipe stock according to any one of the present inventions (1) to (7) or the Ni base alloy pipe stock manufactured by the method of the present inventions (8) or (9) can be easily manufactured into a desired Ni base alloy seamless pipe by working it by the general method, for example, by expanding the diameter by use of an elongator, such as a mandrel mill, a plug mill, an Assel mill or a push bench to reduce the wall thickness, and then by narrowing the outer diameter by use of a reducing mill, such as a stretch reducing mill or a sizing mill.

The present invention will be described in more detail in reference to preferred embodiments.

PREFERRED EMBODIMENT

Example 1

Various kinds of alloys, having chemical compositions shown in Tables 1 and 2, were melted by use of a 150 kg vacuum induction melting furnace in the ordinary manner, and casted to form ingots. In Tables 1 and 2, the alloys 1 to 23 are the alloys of the inventive examples in which the chemical compositions are within the range regulated by the present invention, and the alloys a to r are the alloys of comparative examples in which the content of any one of the components is out of the range regulated by the present invention. Among the alloys of comparative examples, the alloys a and b correspond to conventional alloys (ASM UNS Nos. N06255 and N10276, respectively).

TABLE 1

| | Chemical composition (% by mass) Balance: Fe and impurities | | | | | | | | | | |
|---|---|---|---|---|---|---|---|---|---|---|---|
| Alloy | C | Si | Mn | P | S | Cr | Ni | Mo | W | Mo + 0.5 W | Cu |
| 1 | 0.004 | 0.12 | 0.14 | 0.008 | 0.0021 | 24.88 | 52.36 | 6.75 | — | 6.75 | 0.71 |
| 2 | 0.006 | 0.08 | 0.52 | 0.007 | 0.0015 | 25.03 | 53.28 | 7.05 | — | 7.05 | 0.15 |
| 3 | 0.007 | 0.02 | 0.10 | 0.007 | 0.0030 | 22.54 | 46.66 | 6.51 | — | 6.51 | 0.76 |
| 4 | 0.002 | 0.06 | 0.49 | 0.009 | 0.0018 | 21.80 | 46.92 | 6.14 | — | 6.14 | 1.12 |
| 5 | 0.008 | 0.14 | 0.48 | 0.003 | 0.0008 | 18.83 | 53.36 | 3.82 | — | 3.82 | 0.92 |
| 6 | 0.006 | 0.07 | 0.45 | 0.003 | 0.0007 | 15.68 | 58.77 | 13.66 | — | 13.66 | 0.87 |
| 7 | 0.012 | 0.19 | 0.09 | 0.004 | 0.0021 | 15.21 | 57.21 | 12.22 | 2.54 | 13.49 | 0.94 |
| 8 | 0.011 | 0.03 | 0.12 | 0.006 | 0.0011 | 24.85 | 55.21 | 6.62 | 3.36 | 8.30 | 1.05 |
| 9 | 0.003 | 0.28 | 0.30 | 0.011 | 0.0005 | 25.51 | 48.87 | 5.53 | — | 5.53 | 0.57 |
| 10 | 0.003 | 0.01 | 0.29 | 0.005 | 0.0007 | 26.89 | 56.68 | 2.38 | 8.44 | 6.60 | 0.08 |
| 11 | 0.005 | 0.01 | 0.10 | 0.008 | 0.0004 | 25.12 | 52.11 | — | 12.26 | 6.13 | 0.44 |
| 12 | 0.007 | 0.13 | 0.33 | 0.008 | 0.0011 | 27.73 | 58.72 | 5.85 | — | 5.85 | 0.75 |
| 13 | 0.009 | 0.08 | 0.15 | 0.005 | 0.0025 | 25.08 | 55.53 | 4.61 | 4.06 | 6.64 | 0.99 |
| 14 | 0.005 | 0.07 | 0.83 | 0.007 | 0.0008 | 25.16 | 54.45 | 6.28 | 4.43 | 8.50 | 0.36 |
| 15 | 0.011 | 0.14 | 0.12 | 0.002 | 0.0007 | 24.42 | 50.36 | 6.33 | — | 6.33 | 0.48 |
| 16 | 0.008 | 0.02 | 0.30 | 0.003 | 0.0015 | 24.67 | 49.86 | 7.91 | 0.57 | 8.20 | 0.82 |
| 17 | 0.008 | 0.32 | 0.32 | 0.007 | 0.0020 | 25.17 | 51.21 | 0.35 | 8.89 | 4.80 | 0.77 |
| 18 | 0.006 | 0.08 | 0.10 | 0.010 | 0.0006 | 25.58 | 52.13 | 6.68 | 0.54 | 6.95 | 0.48 |
| 19 | 0.006 | 0.16 | 0.30 | 0.005 | 0.0013 | 25.61 | 50.18 | 6.11 | — | 6.11 | 0.62 |
| 20 | 0.014 | 0.01 | 0.14 | 0.002 | 0.0008 | 23.88 | 52.06 | 6.34 | — | 6.34 | 1.05 |
| 21 | 0.003 | 0.05 | 5.03 | 0.006 | 0.0008 | 25.30 | 52.38 | 7.11 | — | 7.11 | 0.81 |
| 22 | 0.006 | 0.08 | 4.11 | 0.005 | 0.0024 | 20.46 | 59.13 | 11.54 | 0.60 | 11.84 | 0.62 |
| 23 | 0.004 | 0.11 | 2.06 | 0.002 | 0.0013 | 22.23 | 57.93 | 8.86 | 0.33 | 9.03 | 0.77 |
| a | 0.013 | 0.41 | 0.62 | 0.015 | 0.0023 | 24.47 | 48.85 | 6.24 | — | 6.24 | 0.86 |
| b | 0.005 | 0.07 | 0.41 | 0.003 | 0.0007 | 15.82 | 63.34 | 15.53 | 3.66 | 17.36 | *— |
| c | *0.053 | 0.35 | 0.60 | 0.012 | 0.0015 | 22.41 | 48.40 | 6.65 | — | 6.65 | 0.94 |
| d | 0.008 | *0.84 | 0.59 | 0.008 | 0.0027 | 23.06 | 51.86 | 7.14 | — | 7.14 | *1.89 |
| e | 0.013 | 0.31 | 1.53 | 0.014 | 0.0043 | 22.34 | 47.77 | 5.08 | 2.23 | 6.20 | 1.33 |
| f | 0.015 | 0.29 | 0.32 | *0.035 | 0.0009 | 24.47 | 52.26 | 4.31 | 3.38 | 6.00 | 1.04 |
| g | 0.007 | 0.13 | 0.47 | 0.009 | *0.0102 | 26.12 | 50.33 | 7.96 | — | 7.96 | 0.99 |
| h | 0.004 | 0.33 | 0.35 | 0.011 | 0.0041 | *14.38 | 47.79 | — | 12.45 | 6.23 | 1.05 |
| i | 0.015 | 0.30 | 0.66 | 0.013 | 0.0027 | *32.55 | 58.84 | 0.23 | 2.86 | 1.66 | 1.42 |
| j | 0.012 | 0.38 | 0.42 | 0.008 | 0.0050 | 25.31 | *42.81 | 8.11 | — | 8.11 | 0.88 |
| k | 0.008 | 0.31 | 0.68 | 0.012 | 0.0028 | 24.88 | 48.63 | *18.89 | — | *18.89 | 1.02 |
| l | 0.007 | 0.35 | 0.42 | 0.007 | 0.0019 | 16.12 | 47.88 | 7.16 | 25.34 | *19.83 | 0.61 |
| m | 0.009 | 0.28 | 0.67 | 0.005 | 0.0022 | 28.42 | 51.13 | 9.61 | 1.01 | 10.12 | *2.04 |
| n | 0.011 | 0.44 | 0.38 | 0.011 | 0.0016 | 25.08 | 52.08 | 4.38 | — | 4.38 | 1.22 |
| o | 0.010 | 0.12 | 0.15 | 0.010 | 0.0014 | 20.97 | 46.66 | 7.63 | 1.75 | 8.51 | 0.31 |
| p | 0.013 | 0.05 | 0.33 | 0.008 | 0.0018 | 21.11 | 48.83 | 1.12 | — | *1.12 | 0.43 |
| q | 0.006 | 0.43 | 0.77 | 0.011 | 0.0015 | 24.82 | *30.61 | 0.89 | — | *0.89 | 0.53 |
| r | 0.009 | 0.25 | *8.32 | 0.009 | 0.0022 | 25.38 | 48.88 | 7.35 | — | 7.35 | 0.71 |

A mark * indicate falling outside the conditions specified by the present invention.

TABLE 2

(continued from Table 1)

| | Chemical composition (% by mass) Balance: Fe and impurities | | | Value of | Value of | Value of |
|---|---|---|---|---|---|---|
| Alloy | Al | N | others | $T_{GBm}$ | $P_{sr}$ | $P_{\sigma}$ |
| 1 | 0.083 | 0.002 | — | 1322.2 | 120.1 | 9.9 |
| 2 | 0.077 | 0.056 | — | 1318.5 | 129.4 | 9.5 |
| 3 | 0.069 | 0.007 | V: 0.23 | 1313.9 | 112.5 | 10.1 |
| 4 | 0.085 | 0.004 | Nb: 0.08 | 1326.0 | 108.7 | 13.7 |
| 5 | 0.073 | 0.003 | — | 1329.7 | 91.9 | 37.6 |

TABLE 2-continued (continued from Table 1)

| Alloy | Chemical composition (% by mass) Balance: Fe and impurities Al | N | others | Value of $T_{GBm}$ | Value of $P_{sr}$ | Value of $P_{\sigma}$ |
|---|---|---|---|---|---|---|
| 6 | 0.059 | 0.004 | B: 0.0032 | 1338.5 | 195.8 | 0.2 |
| 7 | 0.081 | 0.003 | Mg: 0.0025 | 1307.0 | 192.4 | 0.4 |
| 8 | 0.052 | 0.007 | Co: 2.01 | 1301.5 | 138.9 | 5.1 |
| 9 | 0.043 | 0.075 | Nd: 0.11 | 1311.8 | 111.7 | 12.0 |
| 10 | 0.088 | 0.124 | — | 1341.7 | 135.1 | 12.1 |
| 11 | 0.076 | 0.005 | Zr0.04, B: 0.0014 | 1318.0 | 113.9 | 12.3 |
| 12 | 0.062 | 0.143 | Hf: 0.12, Co: 1.22, B: 0.0010 | 1309.1 | 131.5 | 16.4 |
| 13 | 0.074 | 0.076 | V: 0.21, Nd: 0.10 | 1315.2 | 129.5 | 14.0 |
| 14 | 0.066 | 0.002 | Hf: 0.13, Ca: 0.08 | 1322.9 | 139.6 | 2.7 |
| 15 | 0.081 | 0.003 | V: 0.18, Nd: 0.07 | 1321.5 | 114.0 | 10.9 |
| 16 | 0.073 | 0.008 | B: 0.0021, Nb: 0.08, Nd: 0.12 | 1329.7 | 132.6 | 0.6 |
| 17 | 0.048 | 0.012 | Ta: 0.24, Co: 2.12 | 1309.6 | 100.4 | 18.0 |
| 18 | 0.052 | 0.025 | Co: 0.46, Y: 0.13, B: 0.0025 | 1303.5 | 124.1 | 7.5 |
| 19 | 0.044 | 0.003 | V: 0.15, B: 0.0030, Co: 0.51, Ca: 0.0033 | 1328.5 | 111.6 | 9.4 |
| 20 | 0.067 | 0.007 | — | 1308.3 | 116.2 | 13.7 |
| 21 | 0.140 | 0.003 | V: 0.12 | 1336.7 | 123.8 | 7.3 |
| 22 | 0.110 | 0.004 | Nd: 0.04 | 1328.4 | 177.9 | 0.1 |
| 23 | 0.080 | 0.008 | — | 1352.3 | 149.0 | 9.4 |
| a | 0.071 | 0.008 | — | * 1247.6 | 112.1 | 9.8 |
| b | * 0.220 | 0.024 | Co: 1.23 | 1342.9 | * 239.3 | * −13.9 |
| c | 0.077 | 0.004 | — | * 1086.7 | 115.3 | 11.4 |
| d | 0.065 | 0.015 | — | 1304.5 | 124.8 | 11.2 |
| e | 0.072 | 0.011 | — | * 1252.4 | 110.8 | 13.2 |
| f | 0.089 | 0.021 | — | * 1138.9 | 114.4 | 14.5 |
| g | 0.090 | 0.005 | — | 1303.2 | 130.4 | * −0.7 |
| h | 0.074 | 0.013 | — | 1307.0 | 111.3 | 29.0 |
| i | 0.081 | * 0.211 | — | * 1248.7 | 96.5 | 28.6 |
| j | 0.066 | 0.084 | — | * 1286.7 | 132.3 | * −6.5 |
| k | 0.083 | 0.035 | — | * 1284.5 | * 241.0 | * −54.2 |
| l | 0.092 | 0.008 | — | 1314.0 | * 247.0 | * −42.4 |
| m | 0.075 | 0.015 | — | 1315.2 | 153.8 | * −15.1 |
| n | * 0.187 | 0.123 | — | * 1276.4 | 108.2 | 22.3 |
| o | 0.063 | * 0.165 | — | * 1285.9 | 148.2 | 4.8 |
| p | 0.076 | 0.008 | — | * 1282.6 | 60.8 | 42.1 |
| q | 0.122 | 0.063 | — | * 1298.5 | 45.8 | 18.2 |
| r | 0.130 | 0.008 | — | * 1295.2 | 123.2 | 2.5 |

A mark * indicate falling outside the conditions specified by the present invention.

Each of the ingots was soaked at 1200° C. for 2 hours, and then hot forged in the ordinary manner to produce, for each alloy, one billet with a 85 mm in diameter, two billets 70 mm in diameter, and one billet 55 mm in diameter for changing the pipe expansion ratio in the piercing and rolling. The finishing temperature of forging in each case was set to not lower than 1000° C.

Each of the thus-obtained billets was heated at 1250° C. for 1 hour, and pierced and rolled into a pipe stock of a size shown in Table 3 by use of a model mill with a pipe expansion ratio H of 1.09 to 1.74. In Table 3, the relationship among the pipe expansion ratio, the billet size and the pipe stock size is shown. The roll cross angle, roll feed angle, draft rate and plug tip draft rate that are piercing conditions of the model mill, that is a piercing and rolling device, are shown in Table 4.

In Table 5, the value of fn represented by the said equation (4) of each alloy is shown separately, for each pipe expansion ratio H of 1.09, 1.36, 1.64 or 1.74 in the piercing and rolling.

TABLE 3

| Billet diameter (mm) | Pipe stock outer diameter (mm) | Pipe stock wall thickness (mm) | Pipe expansion ratio H |
|---|---|---|---|
| 85.0 | 93.0 | 6.5 | 1.09 |
| 85.0 | 115.5 | 5.5 | 1.36 |
| 70.0 | 115.0 | 6.5 | 1.64 |
| 55.0 | 95.5 | 5.5 | 1.74 |

TABLE 4

| Piercing and rolling condition by model mill | |
|---|---|
| Roll cross angle | 7 deg. |
| Roll feed angle | 9 deg. |
| Draft rate | 10.7% |
| Plug tip draft rate | 6% |

TABLE 5

| Alloy | fn value for following pipe expansion ratio H 1.09 | 1.36 | 1.64 | 1.74 |
|---|---|---|---|---|
| 1 | ** 0.324449 | 0.151884 | 0.087286 | 0.074042 |
| 2 | 0.220471 | 0.105872 | 0.061544 | 0.052343 |

TABLE 5-continued

| Alloy | fn value for following pipe expansion ratio H | | | |
|---|---|---|---|---|
| | 1.09 | 1.36 | 1.64 | 1.74 |
| 3 | ** 0.387872 | 0.168280 | 0.093210 | 0.078383 |
| 4 | ** 0.352564 | 0.170581 | 0.099487 | 0.084676 |
| 5 | 0.046118 | 0.021542 | 0.012368 | 0.010489 |
| 6 | 0.042398 | 0.020155 | 0.011664 | 0.009910 |
| 7 | 0.163138 | 0.068551 | 0.037338 | 0.031270 |
| 8 | 0.150991 | 0.073687 | 0.043137 | 0.036746 |
| 9 | ** 0.412837 | 0.212381 | 0.127083 | 0.108784 |
| 10 | 0.096168 | 0.047933 | 0.028313 | 0.024167 |
| 11 | 0.219049 | 0.112590 | 0.067348 | 0.057646 |
| 12 | 0.245089 | 0.122298 | 0.072274 | 0.061696 |
| 13 | 0.239016 | 0.101188 | 0.055335 | 0.046388 |
| 14 | 0.180543 | 0.090987 | 0.053991 | 0.046131 |
| 15 | 0.025595 | 0.011475 | 0.006461 | 0.005455 |
| 16 | 0.086046 | 0.036428 | 0.019921 | 0.016700 |
| 17 | 0.263871 | 0.122052 | 0.069754 | 0.059094 |
| 18 | ** 0.344992 | 0.176940 | 0.105747 | 0.090496 |
| 19 | 0.125928 | 0.059028 | 0.033943 | 0.028796 |
| 20 | 0.029315 | 0.012862 | 0.007165 | 0.006033 |
| 21 | 0.136855 | 0.068417 | 0.040463 | 0.034547 |
| 22 | 0.226864 | 0.096657 | 0.053037 | 0.044498 |
| 23 | 0.055355 | 0.022569 | 0.012091 | 0.010084 |
| * a | ** 0.887336 | ** 0.439534 | 0.258948 | 0.220898 |
| * b | 0.042398 | 0.020155 | 0.011664 | 0.009910 |
| * c | ** 0.539732 | 0.270803 | 0.160399 | 0.136994 |
| * d | ** 0.395873 | 0.178511 | 0.100797 | 0.085152 |
| * e | ** 1.117238 | 0.511228 | 0.290697 | 0.245981 |
| * f | ** 4.136870 | ** 2.134225 | ** 1.278514 | ** 1.094682 |
| * g | ** 2.852409 | ** 1.102533 | ** 0.572371 | ** 0.473550 |
| * h | ** 0.823526 | ** 0.365487 | 0.204771 | 0.172670 |
| * i | ** 0.748740 | ** 0.360803 | 0.210058 | 0.178714 |
| * j | ** 0.835082 | ** 0.342250 | 0.183880 | 0.153475 |
| * k | ** 0.678364 | ** 0.322485 | 0.186624 | 0.158559 |
| * l | 0.254199 | 0.118446 | 0.067924 | 0.057589 |
| * m | 0.204048 | 0.088151 | 0.048721 | 0.040949 |
| * n | ** 0.470125 | 0.233738 | 0.137920 | 0.117695 |
| * o | ** 0.384672 | 0.191732 | 0.113253 | 0.096668 |
| * p | 0.295433 | 0.141067 | 0.081797 | 0.069528 |
| * q | ** 0.462437 | 0.230872 | 0.136466 | 0.116499 |
| * r | ** 0.392244 | 0.185374 | 0.106993 | 0.090849 |

A mark * indicate the alloy whose chemical compositions are falling outside the conditions specified by the present invention.
A mark ** indicate falling outside the conditions specified by the present inventions (7) and (9).

Each of the thus-obtained pipe stocks was examined for cracks and flaws, namely, for the two-piece cracks resulting from the intergranular fusion, the inside surface scabs, and the inside surface cracks and the scabs on both the inside and outside surface resulting from the sigma phase formation.

The examination results for cracks and flaws are collectively shown in Table 6. The marks "○○", "○" "Δ" and "×" in Table 6 mean that "no cracks or flaws were observed", "small flaws were observed in spite of absence of cracks", "large flaws were observed in spite of absence of cracks", and "cracks were observed", respectively.

With respect to the alloys 1 to 23 and the alloys q and r whose examination results for cracks and flaws in the said pipe stocks include the evaluation "○○", those with a pipe expansion ratio H of 1.36 were representatively subjected to a solution heat treatment holding at 1050° C. for 30 minutes followed by water cooling. Thereafter, an oblong steel stock 5 mm in thickness, 12 mm in width and 150 mm in length was cut off and cold rolled by the general method into a plate 3.5 mm in thickness, and this was used as a steel stock and examined for tensile properties and corrosion resistance.

That is to say, a tensile test piece with a diameter of 3 mm and a gauge length of 15 mm was cut off from the above-mentioned 3.5 mm thick plate and subjected to a tensile test at room temperature in the atmosphere to measure the yield strength (YS) and the elongation (El).

A four-point bending corrosion test piece 10 mm in width, 2 mm in thickness and 75 mm in length, having a notch part with radius of 0.25 mm, was produced from the 3.5 mm thick plate, and the corrosion resistance, namely, the stress corrosion cracking resistance in a sour gas environment in the following condition was evaluated.

Test solution: 20% NaCl-0.5% $CH_3COOH$,

Test gas: Hydrogen sulfide partial pressure 1013250 Pa-carbon dioxide partial pressure 2026500 Pa (10 atm $H_2S$-20 atm $CO_2$), Test temperature: 221° C., Dipping time: 1000 hours Applied stress: 1×YS.

The tensile test results and the corrosion test results are collectively shown in Table 6. In Table 6, the marks "○" and "×" of the column of corrosion resistance (stress corrosion cracking resistance in sour gas environment) mean that no cracks were observed and that cracks were observed, respectively. The mark "-", in the columns of tensile properties and corrosion resistance for the alloys a to p, means that no test was carried out because of the absence of pierced and rolled pipe stocks having the evaluation of "○○" for cracks and flaws.

TABLE 6

| Alloy | Cracks and flaws on the pipe stock for following pipe expansion ratio H 1.09 | 1.36 | 1.64 | 1.74 | Tensile properties Yield strength [YS] (MPa) | Elongation [El] (%) | Corrosion resistance (stress corrosion resistance in sour gas environment) |
|---|---|---|---|---|---|---|---|
| 1 | ○ | ○○ | ○○ | ○○ | 896 | 24.3 | ○ |
| 2 | ○○ | ○○ | ○○ | ○○ | 902 | 25.7 | ○ |
| 3 | ○○ | ○○ | ○○ | ○○ | 913 | 26.3 | ○ |
| 4 | ○○ | ○○ | ○○ | ○○ | 885 | 25.0 | ○ |
| 5 | ○○ | ○○ | ○○ | ○○ | 937 | 24.7 | ○ |
| 6 | ○○ | ○○ | ○○ | ○○ | 1036 | 23.7 | ○ |
| 7 | ○○ | ○○ | ○○ | ○○ | 940 | 26.3 | ○ |
| 8 | ○ | ○○ | ○○ | ○○ | 893 | 27.3 | ○ |
| 9 | ○○ | ○○ | ○○ | ○○ | 911 | 25.7 | ○ |
| 10 | ○○ | ○○ | ○○ | ○○ | 924 | 26.3 | ○ |
| 11 | ○○ | ○○ | ○○ | ○○ | 897 | 26.7 | ○ |
| 12 | ○○ | ○○ | ○○ | ○○ | 883 | 27.0 | ○ |
| 13 | ○○ | ○○ | ○○ | ○○ | 908 | 26.7 | ○ |
| 14 | ○○ | ○○ | ○○ | ○○ | 926 | 24.7 | ○ |
| 15 | ○○ | ○○ | ○○ | ○○ | 981 | 25.3 | ○ |
| 16 | ○○ | ○○ | ○○ | ○○ | 1013 | 23.0 | ○ |
| 17 | ○ | ○○ | ○○ | ○○ | 945 | 29.7 | ○ |
| 18 | ○○ | ○○ | ○○ | ○○ | 992 | 22.7 | ○ |
| 19 | ○ | ○○ | ○○ | ○○ | 896 | 26.0 | ○ |
| 20 | ○○ | ○○ | ○○ | ○○ | 870 | 23.3 | ○ |
| 21 | ○○ | ○○ | ○○ | ○○ | 986 | 22.5 | ○ |
| 22 | ○○ | ○○ | ○○ | ○○ | 1121 | 24.1 | ○ |
| 23 | ○○ | ○○ | ○○ | ○○ | 933 | 23.8 | ○ |
| * a | x | ○ | ○ | ○ | — | — | — |
| * b | x | x | ○ | ○ | — | — | — |
| * c | x | x | x | ○ | — | — | — |
| * d | x | x | x | ○ | — | — | — |
| * e | x | x | x | ○ | — | — | — |
| * f | x | x | x | ○ | — | — | — |
| * g | x | x | x | ○ | — | — | — |
| * h | Δ | ○ | ○ | ○ | — | — | — |
| * i | x | x | ○ | ○ | — | — | — |
| * j | Δ | Δ | Δ | Δ | — | — | — |
| * k | Δ | Δ | Δ | Δ | — | — | — |
| * l | Δ | Δ | Δ | Δ | — | — | — |
| * m | x | x | x | ○ | — | — | — |
| * n | x | Δ | ○ | ○ | — | — | — |
| * o | x | x | x | ○ | — | — | — |
| * p | x | x | ○ | ○ | — | — | — |
| * q | ○ | ○○ | ○○ | ○○ | 861 | 25.3 | x |
| * r | x | ○○ | ○○ | ○○ | 949 | 21.3 | x |

A mark "—" in the columns of tensile properties and corrosion resistance means that no tests were carried out because of absence of pierced and rolled pipe stock having the evaluation of "○○" for cracks and flaws.
A mark * indicate the alloy whose chemical compositions are falling outside the conditions specified by the present invention.

As is apparent from Table 6, when the alloys 1 to 23, which are the Ni base alloys according to the present invention, are used, the examination results for cracks and flaws after piercing and rolling was "○○" in most cases, with a slight number of cases with "○". That is to say, these alloys are excellent in surface property with no cracks and only small flaws.

Further, the examination results for tensile properties and corrosion resistance in the use of the alloys 1 to 23 were satisfactory. That is to say, these alloys are excellent in strength and toughness with a large YS exceeding 800 MPa and a large elongation exceeding 20%, and also excellent in the corrosion resistance in the said severe sour gas environment.

Consequently, it is apparent that seamless pipes excellent in the corrosion resistance in a sour gas environment in addition to excellent mechanical properties can be mass-produced on an industrial scale by using the pipe stocks obtained by piercing and rolling billets of the Ni base alloys according to the present invention by the general method.

In contrast to this, the examination results for cracks and flaws after piercing and rolling in the use of the alloy q, that is an alloy of comparative example, were "○○" or "○". That is to say, it is excellent in surface properties with no cracks and only small flaws. However, the corrosion test result thereof was "x", which apparently shows that the corrosion resistance in the said severe sour gas environment was poor.

The examination results for cracks and flaws after piercing and rolling in the use of the alloy r, that is an alloy of comparative example, were "○○" or "x". That is to say, it shows that cracking may have taken place. And the corrosion resistance test result thereof was "x", which apparently shows that the corrosion resistance in the said severe sour gas environment was also poor.

In the use of the alloys a to p, which are the alloys of comparative examples, the examination results for cracks and flaws after piercing and rolling were "○" at most. That is to say, the piercing and rolling thereof caused large flaws although no cracks was caused. Therefore, it is apparent that, even if the pipe stocks obtained by piercing and rolling billets of such alloys by the general method are used, seamless pipes excellent in the corrosion resistance in a sour gas environment in addition to excellent mechanical properties cannot be mass-produced on an industrial scale.

Example 2

A Ni base alloy having a chemical composition, equivalent to that of the alloy 1 in Table 1, was melted by use of real equipment, and then bloomed and rolled to produce five billets 147 mm in diameter. The chemical composition of this Ni base alloy is shown in Table 7.

TABLE 7

| Chemical composition (% by mass) Balance: Fe and impurities | | | | | | | | | | | | |
|---|---|---|---|---|---|---|---|---|---|---|---|---|
| C | Si | Mn | P | S | Cr | Ni | Mo | W | Mo + 0.5 W | Cu | Al | N |
| 0.008 | 0.11 | 0.13 | 0.008 | 0.0015 | 24.89 | 52.53 | 6.24 | — | 6.24 | 0.83 | 0.090 | 0.007 |

| Value of $T_{GBm}$ | Value of $P_{sr}$ | Value of $P_{\sigma}$ |
|---|---|---|
| 1304.7 | 115.7 | 12.6 |

Each billet was heated to 1230° C. and made into a pipe by use of real equipment in a condition shown in Table 8 to produce a pipe stock with outer diameter of 235 mm and thickness of 15 mm. Since the pipe expansion ratio H in piercing and rolling of this case is 1.5, the value of fn represented by the said equation (4) is 0.099028. As a piercer plug suitable for piercing and rolling of Ni base alloys, one made of a material consisting of 0.5% Cr-1.0% Ni-3.0% W series with a tensile strength at 900° C. of 90 MPa and a total scale thickness before use of 600 μm was used.

TABLE 8

| Piercing and rolling condition by real equipment | |
|---|---|
| Roll cross angle | 7 deg. |
| Roll feed angle | 9 deg. |
| Draft rate | 10.7% |
| Plug tip draft rate | 6% |

The five pipe stocks were examined for the cracks and flaws, namely, for the two-piece cracks resulting from the intergranular fusion, the inside surface scabs, and the inside surface cracks and the scabs on both the inside and outside surface resulting from the sigma phase formation. Consequently, each pipe stock could be confirmed to have satisfactory surface properties free from cracks and flaws.

Each of the said five pipe stocks was cold drawn at 30% in terms of the reduction in the cross-sectional area and then carried out a solution heat treatment of heating to 1120° C. followed by water cooling, and further subjected to a cold drawing of 30% in terms of the reduction in the cross-sectional area.

The same tensile test pieces and corrosion test pieces as in Example 1 were cut off from the longitudinal direction of the thus-obtained pipes, and examined for tensile properties and corrosion resistance.

That is to say, a tensile test piece with a diameter of 3 mm and a gauge length of 15 mm was cut off from the longitudinal direction of each pipe, and subjected to a tensile test at room temperature in the atmosphere to measure the yield strength (YS) and the elongation (El).

A four-point bending corrosion test piece 10 mm in width, 2 mm in thickness and 75 mm in length, having a notch part with radius of 0.25 mm, was produced from the said pipe, and the corrosion resistance, namely, the stress corrosion cracking resistance in a sour gas environment in the following condition was evaluated.

Test solution: 20% NaCl-0.5% $CH_3COOH$,

Test gas: Hydrogen sulfide partial pressure 1013250 Pa-carbon dioxide partial pressure 2026500 Pa (10 atm $H_2S$-20 atm $CO_2$), Test temperature: 221° C., Dipping time: 1000 hours Applied stress: 1×YS.

The tensile test results and corrosion resistance test results are collectively shown in Table 9. In Table 9, the mark "○" of the column of corrosion resistance (stress corrosion cracking resistance in sour gas environment) means that no cracks were observed.

TABLE 9

| | Tensile properties | | Corrosion resistance |
|---|---|---|---|
| Pipe | Yield strength [YS] (MPa) | Elongation [El] (%) | (stress corrosion resistance in sour gas environment) |
| 1 | 983 | 24.3 | ○ |
| 2 | 969 | 23.5 | ○ |
| 3 | 986 | 24.8 | ○ |
| 4 | 964 | 21.6 | ○ |
| 5 | 961 | 25.5 | ○ |

As is apparent from Table 9, each pipe has satisfactory strength and ductility, and further extremely satisfactory corrosion resistance.

Although only some exemplary embodiments of the present invention have been described in detail above, those skilled in the art will readily appreciated that many modifications are possible in the exemplary embodiments without materially departing from the novel teachings and advantages of the present invention. Accordingly, all such modifications are intended to be included within the scope of the present invention.

INDUSTRIAL APPLICABILITY

The Ni base alloy pipe stocks of the present invention have excellent inside surface properties. Therefore, the pipe stocks can be manufactured into seamless pipes of desired dimensions by working them by the general method, for example, by expanding the diameter by use of an elongator, such as a mandrel mill, a plug mill, an Assel mill or a push bench to reduce the wall thickness, and then by narrowing the outer diameter by use of a reducing mill, such as a stretch reducing mill or a sizing mill. The resulting seamless pipes have excellent mechanical properties and moreover have excellent corrosion resistance in a sour gas environment, and thus, the Ni base alloy pipe stocks of the present invention can be used as pipe stocks for oil country tubular goods and line pipes and further as pipe stocks for various structural members of nuclear power plants and chemical industrial plants. The Ni base alloy pipe stocks can be easily mass-produced at a low cost by the method of the present invention.

What is claimed is:

1. A method for manufacturing an Ni base alloy pipe stock, comprising piercing and rolling a billet, by use of a Mannesmann piercing and rolling mill, which satisfies the chemical compositions consisting of, by mass %, C: not more than 0.04%, Si: not more than 0.50%, Mn: 0.01 to 6.0%, P: not more than 0.03%, S: not more than 0.01%, Cr: 15 to 30%, Ni: more than 45% to not more than 60%, Mo: 0 to 18%, W: 0 to 36%, with Mo (%)+0.5W (%): more than 1.5% to not more than 18%, Cu: 0.01 to 1.5%, Al: not more than 0.10% and N: 0.005 to 0.20%, and the balance being substantially Fe, with values of $T_{GBm}$, $P_{sr}$ and $P_{\sigma}$ represented by the following equations (1) to (3) being not more than 1300, not more than 200 and not less than 0, respectively, and moreover being subjected to piercing and rolling by a Mannesmann piercing and rolling mill:

$$T_{GBm}=1380-5000P-100S-4400C \quad (1),$$

$$P_{sr}\text{Ni}+10(\text{Mo}+0.5\text{W})+100\text{N} \quad (2),$$

$$P_{\sigma}=(\text{Ni}-50)+10(\text{N}-0.1)-2(\text{Cr}-25)-5(\text{Mo}+0.5\text{W}-6)+12 \quad (3),$$

wherein each element symbol in the equations (1) to (3) represents the content by mass % of the element concerned.

2. The method for manufacturing an Ni base alloy pipe stock according to claim 1, wherein the piercing and rolling by the Mannesmann piercing and rolling mill is performed in a condition where the value of fn represented by the following equation (4) is not more than 0.3:

$$fn=\{P/(0.025H-0.01)\}^2+\{S/(0.015H-0.01)\}^2 \quad (4),$$

wherein P and S represent contents, by mass %, of P and S in the pipe stock, respectively, and H represents the pipe expansion ratio represented by the ratio of the outer diameter of the pipe stock to the diameter of the steel stock billet.

3. A method for manufacturing an Ni base alloy pipe stock, comprising piercing and rolling a billet, by use of a Mannesmann piercing and rolling mill, which satisfies the chemical compositions consisting essentially of, by mass %, C: not more than 0.04%, Si: not more than 0.50%, Mn: 0.01 to 6.0%, P: not more than 0.03%, S: not more than 0.01%, Cr: 15 to 30%, Ni: more than 45% to not more than 60%, Mo: 0 to 18%, W: 0 to 36%, with Mo (%)+0.5W (%): more than 1.5% to not more than 18%, Cu: 0.01 to 1.5%, Al: not more than 0.10% and N: 0.005 to 0.20%, and the balance being substantially Fe, with values of $T_{GBm}$, $P_{sr}$ and $P_{\sigma}$ represented by the following equations (1) to (3) being not more than 1300, not more than 200 and not less than 0, respectively, and moreover being subjected to piercing and rolling by a Mannesmann piercing and rolling mill:

$$T_{GBm}=1380-5000P-100S-4400C \quad (1),$$

$$P_{sr}\text{Ni}+10(\text{Mo}+0.5\text{W})+100\text{N} \quad (2),$$

$$P_{\sigma}=(\text{Ni}-50)+10(\text{N}-0.1)-2(\text{Cr}-25)-5(\text{Mo}+0.5\text{W}-6)+12 \quad (3),$$

wherein each element symbol in the equations (1) to (3) represents the content by mass % of the element concerned, and which further consists essentially of an element or elements of one or more groups selected from the groups (a) to (d) listed below in lieu of part of Fe:

(a): one or more selected from among V: 0.001 to 0.3%, Nb: 0.001 to 0.3%, Ta: 0.001 to 1.0%, Ti: 0.001 to 1.0%, Zr: 0.001 to 1.0% and Hf: 0.001 to 1.0% by mass %;

(b): B: 0.0001 to 0.015% by mass %;

(c): Co: 0.3 to 5.0% by mass %;

(d): one or more selected from among Mg: 0.0001 to 0.010%, Ca: 0.0001 to 0.010%, La: 0.0001 to 0.20%, Ce: 0.0001 to 0.20%, Y: 0.0001 to 0.40%, Sm: 0.0001 to 0.40%, Pr: 0.0001 to 0.40% and Nd: 0.0001 to 0.50% by mass %.

4. The method for manufacturing an Ni base alloy pipe stock according to claim 3, wherein the piercing and rolling by the Mannesmann piercing and rolling mill is performed in a condition where the value of fn represented by the following equation (4) is not more than 0.3:

$$fn=\{P/(0.025H-0.01)\}^2+\{S/(0.015H-0.01)\}^2 \quad (4),$$

wherein P and S represent contents, by mass %, of P and S in the pipe stock, respectively, and H represents the pipe expansion ratio represented by the ratio of the outer diameter of the pipe stock to the diameter of the steel stock billet.

* * * * *

UNITED STATES PATENT AND TRADEMARK OFFICE

CERTIFICATE OF CORRECTION

PATENT NO. : 9,034,125 B2
APPLICATION NO. : 13/917951
DATED : May 19, 2015
INVENTOR(S) : Igarashi et al.

It is certified that error appears in the above-identified patent and that said Letters Patent is hereby corrected as shown below:

On the title page item (72), line 4,

"Hisashi Amaya Amaya" should be listed as "Hisashi Amaya"

Signed and Sealed this
Twenty-ninth Day of March, 2016

Michelle K. Lee

Michelle K. Lee
*Director of the United States Patent and Trademark Office*